US007262335B2

(12) United States Patent
Motsch et al.

(10) Patent No.: US 7,262,335 B2
(45) Date of Patent: Aug. 28, 2007

(54) EASY-OPEN, RE-CLOSABLE PACKAGE FOR DISPOSABLE DIAPERS

(75) Inventors: Andreas Peter Motsch, Waldems (DE); Martin Werner Frank, Bad Vilbel (DE)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 11/074,095

(22) Filed: Mar. 7, 2005

(65) Prior Publication Data

US 2006/0200107 A1 Sep. 7, 2006

(51) Int. Cl.
*A61F 13/15* (2006.01)
*B65D 65/28* (2006.01)
*B65D 65/32* (2006.01)

(52) U.S. Cl. ..... 604/358; 383/207; 383/204; 206/440

(58) Field of Classification Search ..... 604/385.29; 383/205, 207, 29, 66, 204; 206/459.5, 440
See application file for complete search history.

(56) References Cited

U.S. PATENT DOCUMENTS 2,095,788 A * 10/1937 Brown ..... 206/440
2,533,255 A * 12/1950 Will ..... 206/264
3,231,083 A * 1/1966 Rumsey, Jr. ..... 206/497
3,399,820 A * 9/1968 Foster et al. ..... 229/207
3,580,466 A 5/1971 Thelan et al.
3,815,810 A * 6/1974 Wellman ..... 383/204
4,252,236 A * 2/1981 Roccaforte ..... 206/449
4,274,541 A * 6/1981 Festag et al. ..... 220/270
4,573,203 A * 2/1986 Peppiatt ..... 383/29
4,762,230 A * 8/1988 Croce ..... 206/469
4,911,563 A * 3/1990 Ciani ..... 383/89
4,940,464 A 7/1990 Van Gompel et al.
5,092,861 A 3/1992 Nomura et al.
5,121,995 A * 6/1992 Newman et al. ..... 383/29
5,246,433 A 9/1993 Hasse et al.
5,375,718 A * 12/1994 Honma et al. ..... 206/497
5,377,837 A * 1/1995 Roussel ..... 206/494
5,443,161 A * 8/1995 Jonese ..... 206/581

(Continued)

OTHER PUBLICATIONS

PCT International Search Report-PCT/US2006/008311.

*Primary Examiner*—Tatyana Zalukaeva
*Assistant Examiner*—Paula L. Craig
(74) *Attorney, Agent, or Firm*—Jack L. Oney, Jr.; Adam J. Forman; Charles R. Ware

(57) ABSTRACT

An easy-open, re-closable package for a plurality of disposable diapers includes a wrapping layer which substantially surrounds the plurality of disposable diapers and a re-closable fastening system. The re-closable fastening system may be joined with the wrapping layer. The re-closable fastening system may have a female fastening portion and a male fastening portion, wherein the female fastening portion and the male fastening portion being releasably engageable. In another exemplary embodiment, the male fastening portion is releasably engageable between the plurality of disposable diapers and the wrapping layer. The re-closable package may also include a removable portion. The removable portion being integrally formed within the re-closable fastening system. The removable portion may include a grip portion. The removable portion may be defined by a first perforation and a second perforation, wherein pulling upon the grip portion results in the tearing along of the perforations so as to open the package.

7 Claims, 5 Drawing Sheets

U.S. PATENT DOCUMENTS 5,482,205 A * 1/1996 Drummond et al. ..... 229/201
5,555,982 A * 9/1996 Kuhn et al. ..... 206/746
5,569,234 A 10/1996 Buell et al.
5,582,342 A * 12/1996 Jud ..... 229/87.05
5,655,843 A 8/1997 Conrad et al.
5,666,445 A * 9/1997 Conrad et al. ..... 383/207
H1748 H * 9/1998 Marinelli et al. ..... 206/83.5
5,897,545 A 4/1999 Kline et al.
5,957,908 A 9/1999 Kline et al.
5,967,665 A * 10/1999 MacDonald et al. ..... 383/207
6,015,045 A * 1/2000 Joseph et al. ..... 206/494
6,120,487 A 9/2000 Ashton
6,120,489 A 9/2000 Johnson et al.
6,427,839 B1 * 8/2002 Helfer-Grand ..... 206/494
6,698,928 B2 * 3/2004 Miller ..... 383/205
2002/0112982 A1 * 8/2002 Stagray et al. ..... 206/494
2002/0148749 A1 * 10/2002 Briseboi et al. ..... 206/440
2003/0024960 A1 * 2/2003 Greenstein et al. ..... 224/153
2003/0115837 A1 * 6/2003 Zimmer et al. ..... 53/436
2003/0228078 A1 * 12/2003 Clune et al. ..... 383/93
2003/0233082 A1 12/2003 Kline et al.
2003/0234199 A1 12/2003 Morita et al.
2004/0134822 A1 7/2004 Otsubo
2004/0232029 A1 * 11/2004 Cotert ..... 206/494
2005/0029143 A1 * 2/2005 Samolinski et al. ..... 206/440
2005/0079322 A1 * 4/2005 Knoerzer et al. ..... 428/136
2005/0121348 A1 6/2005 Clare et al.
2006/0124494 A1 * 6/2006 Clark et al. ..... 206/440
2006/0131200 A1 * 6/2006 Boldra et al. ..... 206/494

* cited by examiner

EASY-OPEN, RE-CLOSABLE PACKAGE FOR DISPOSABLE DIAPERS

FIELD OF THE INVENTION

This invention relates to an easy-open, re-closable package for disposable diapers. Further, this invention relates to an easy-open, re-closable package made of a wrapping layer for disposable diapers.

BACKGROUND OF THE INVENTION

Conventional disposable diapers are often packaged and sold in a conventional flexible film material (e.g., low density polyethylene). While such conventional flexible film materials provide sufficient barrier properties to ensure proper hygiene of the enclosed disposable diaper prior to being opened, once a new package of conventional disposable diaper products are opened, the barrier properties of the conventional shrink wrap are significantly diminished. In addition to hygiene concerns, once individual diapers are removed from the firmly compacted stack of diapers, the opened disposable diaper product becomes organizationally unruly. In an attempt to overcome such problems, caregivers routinely carry diaper bags so as to contain these opened disposable diaper products. However, carrying a diaper bag is not necessarily convenient. Further, particularly at a changing station permanently located at the caregiver's home, the use of a bulky diaper bag is not necessary and is often less preferred as it creates additional clutter in an already crowded space.

What is needed is an inexpensive and convenient means for opening and re-closing disposable diaper products so as to provide sufficient hygiene protection and continued organization of the remaining diapers.

SUMMARY OF THE INVENTION

An easy-open, re-closable package for a plurality of disposable diapers. The package including a plurality of disposable diapers, a wrapping layer which substantially surrounds the plurality of disposable diapers and a re-closable fastening system. The re-closable fastening system may be joined with said wrapping layer. The re-closable fastening system may have a female fastening portion and a male fastening portion, wherein said female fastening portion and said male fastening portion being releasably engageable. In another exemplary embodiment, the male fastening portion is releasably engageable between said plurality of disposable diapers and said wrapping layer. The re-closable package may also include a removable portion. The removable portion being integrally formed within the re-closable fastening system. The removable portion may include a grip portion. The removable portion may be defined by a first perforation and a second perforation, wherein pulling upon the grip portion results in the tearing along of said perforations so as to open the package.

BRIEF DESCRIPTION OF THE DRAWINGS

While the specification concludes with claims particularly pointing out and distinctly claiming the subject matter that is regarded as the present invention, it is believed that the invention will be more fully understood from the following description taken in conjunction with the accompanying drawings. None of the drawings are necessarily to scale.

DETAILED DESCRIPTION OF THE INVENTION

Definitions

Figure 1:
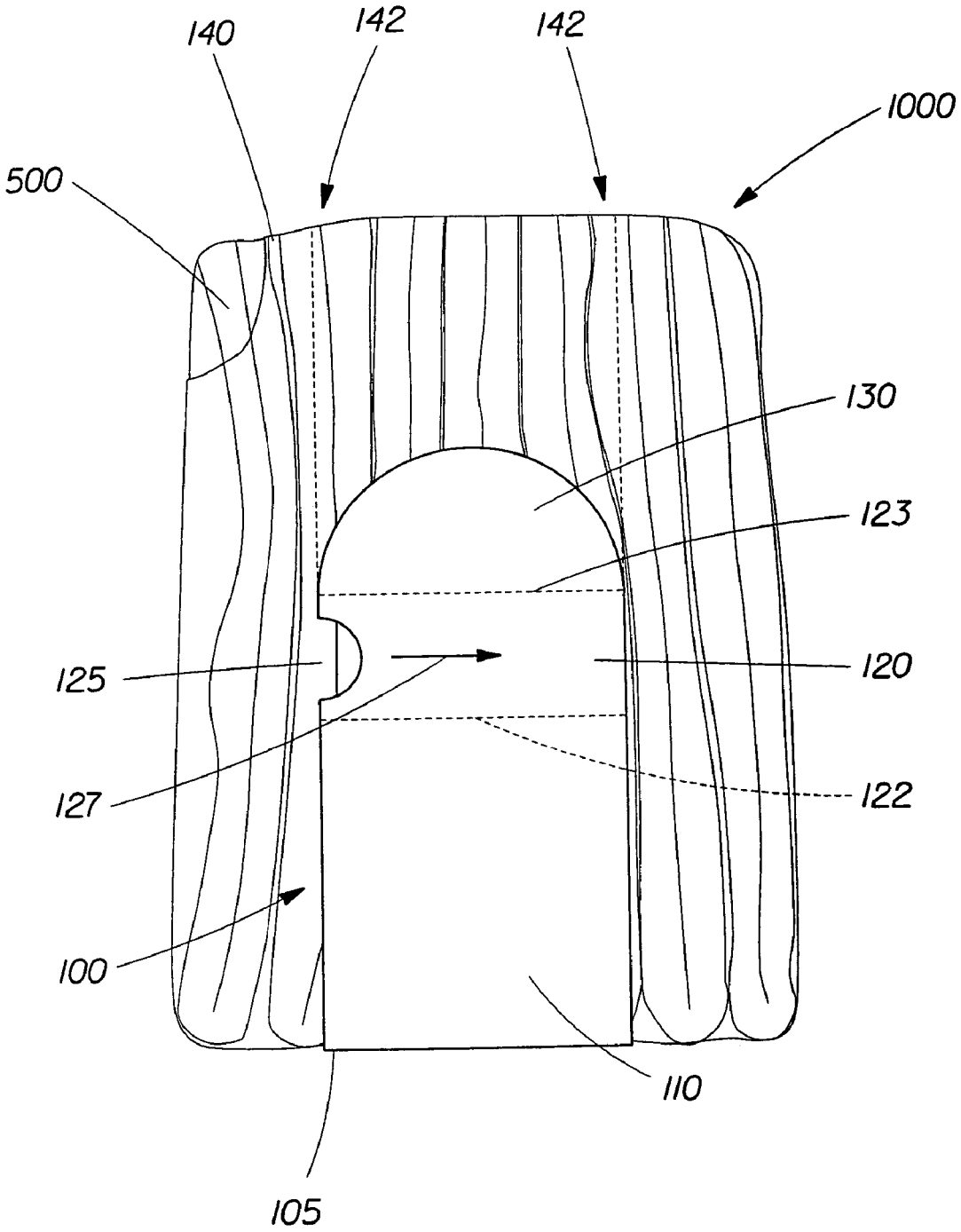
FIG. 1 is a front, elevational view of an exemplary easy-open, re-closable package for disposable diapers in accordance with the present invention.

The term "disposable" is used herein to describe absorbent articles which generally are not intended to be laundered or otherwise restored or reused as absorbent articles (i.e., they are intended to be discarded after a single use and, preferably, to be recycled, composted or otherwise discarded in an environmentally compatible manner).

The term "diaper" herein refers to an absorbent article generally worn by infants and incontinent persons about the lower torso.

The term "absorbent article" herein refers to devices which absorb and contain body exudates and, more specifically, refers to devices which are placed against or in proximity to the body of the wearer to absorb and contain the various exudates discharged from the body. Said absorbent article may have an absorbent core having a garment surface and a body surface; a liquid permeable topsheet positioned adjacent said body surface of said absorbent core; and a liquid impermeable backsheet positioned adjacent said garment surface of said absorbent core.

The term "pant", as used herein, refers to disposable absorbent articles having a waist opening and leg openings designed for infant or adult wearers. A pant may be placed in position on the wearer by inserting the wearer's legs into the leg openings and sliding the pant into position about the wearer's lower torso. A pant may be preformed by any suitable technique including, but not limited to, joining together portions of the article using refastenable and/or non-refastenable bonds (e.g., seam, weld, adhesive, cohesive bond, fastener, etc.). A pant may be preformed anywhere along the circumference of the article (e.g., side fastened, front waist fastened). While the term "pant" is used herein, pants are also commonly referred to as "closed diapers", "prefastened diapers", "pull-on diapers", "training pants" and "diaper-pants". Suitable pants are disclosed in U.S. Pat. No. 5,246,433, issued to Hasse, et al. on Sep. 21, 1993; U.S. Pat. No. 5,569,234, issued to Buell et al. on Oct. 29, 1996; U.S. Pat. No. 6,120,487, issued to Ashton on Sep. 19, 2000; U.S. Pat. No. 6,120,489, issued to Johnson et al. on Sep. 19, 2000; U.S. Pat. No. 4,940,464, issued to Van Gompel et al. on Jul. 10, 1990; U.S. Pat. No. 5,092,861, issued to Nomura et al. on Mar. 3, 1992; U.S. patent application Ser. No. 10/171,249, entitled "Highly Flexible And Low Deformation Fastening Device", filed on Jun. 13, 2002; U.S. Pat. No. 5,897,545, issued to Kline et al. on Apr. 27, 1999; U.S. Pat. No. 5,957,908, issued to Kline et al on Sep. 28, 1999.

The term "machine direction (MD)" or "longitudinal" herein refers to a direction running parallel to the maximum linear dimension of the article and/or fastening material and includes directions within ±45° of the longitudinal direction.

The term "cross direction (CD)", "lateral" or "transverse" herein refers to a direction which is orthogonal to the longitudinal direction.

The term "joined" encompasses configurations whereby an element is directly secured to another element by affixing the element directly to the other element, and configurations whereby an element is indirectly secured to another element by affixing the element to intermediate member(s) which in turn are affixed to the other element. The term "babies" ("baby" in singular) is intended to describe persons ranging in age from newborn to about 2–7 years old. Young children often referred to variously as toddlers, pre-school aged children, or even school aged children all come within this definition. It is specially contemplated that the definition of babies as used herein will encompass children of an age who can talk and have greater dexterity, motor skills and the like than younger babies (for example, as compared to newborn babies). Such older babies (as the term is used herein) may be able to use baby wet wipes products themselves while younger babies may need a caregiver to use the product on them. There is no single upper age limit for babies (as that term is used herein) and it will be recognized that babies progress through stages of development at differing rates. The characteristics of the stages and situations (described in greater detail below) may be more significant than the typical age ranges associated with such stages and situations. Age ranges are by necessity averages and generalities. The ability of the line ups of the present invention to target on the basis of situation and stage (as determined without strict reference to age) is one of its benefits. While no particular upper age limit exists for babies, it is typical that those making the ultimate purchase decision with respect to particular products in the line up will not be a baby within the meaning defined above. In other words, even though older babies may be involved in the use and purchase of baby wipes for their stage or use situation, they often will not make the entire purchase decision on their own (as an example, a 5 year old might tell his or her parent what product he or she desires, but ultimately the parent makes the decision to purchase or not).

Description

Figure 2:
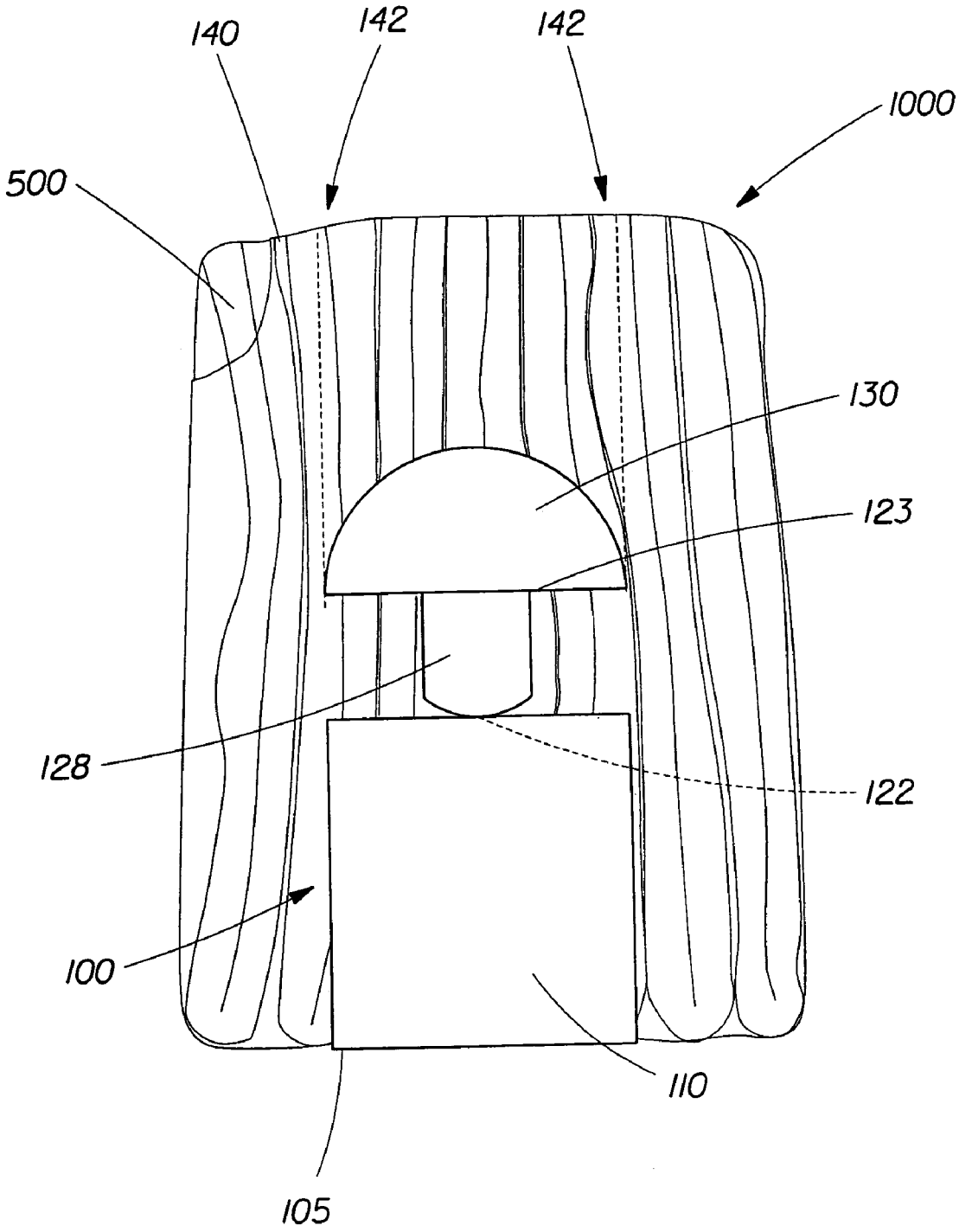
FIG. 2 is a front, elevational view of the easy-open, re-closable package from FIG. 1 wherein the removable portion has been removed.

FIG. 1 depicts an exemplary easy-open, re-closable disposable diaper package 1000 in accordance with the present invention. Said easy-open, re-closable package 1000 may comprise of an easy-open, re-closable fastening system 100, a wrapping layer 140, a perforation 142 within said wrapping layer, and a plurality of disposable diapers 500. Easy-open, re-closable fastening system 100 may include a female fastening portion 110, a removable portion 120, and a male fastening portion 130. As shown in FIG. 1, said easy-open, re-closable fastening system 100 is depicted in a closed and not yet opened position. Further, the unopened easy-open, re-closable fastening system 100 is shown having perforations 122, 123 which separate female fastening portion 110 from removable portion 120 and removable portion 120 from male fastening portion 130, respectively. Removable portion 120 may also include a grip portion 125 in which a caregiver may grab and subsequently pull in a direction as indicated by arrow 127; thus, resulting in the tearing along perforations 122, 123 so as to easily open package 1000. FIG. 2 shows removable portion 120 being removed. Now visible is the male fastening tab 128 which may be used for lifting upwardly said male fastening portion 130 so as to tear perforation 142. Additionally, said male fastening tab 128 may be later used for re-closing of package 1000.

Figure 3:
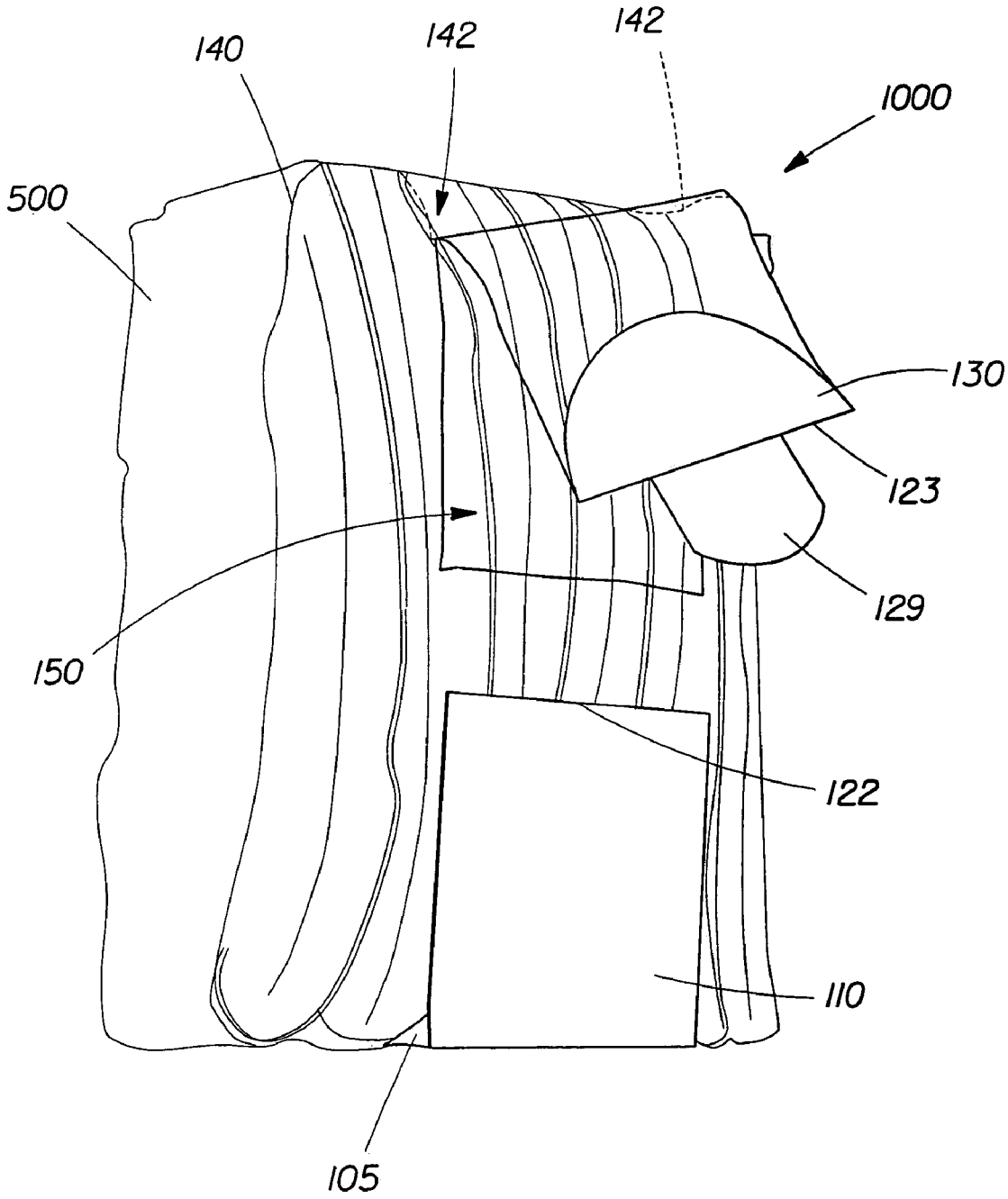
FIG. 3 is a perspective view of the easy-open, re-closable package from FIG. 2 wherein an opening has been made to permit removal of disposable diapers from the package.

FIG. 3 shows easy-open, re-closable package 1000 being opened. More specifically, male fastening portion 130 may be lifted upwardly so as to tear perforations 142 and thus create an opening 150. In this way, the predefined, perforated area of opening 150 provides a clean and organized means for removing disposable diapers from the package as compared to merely ripping the package open. Further, said perforation 142 provides clean, predictable edges for re-closing of the package as compared to non-supplementary, non-predictable edges from merely ripping the package open.

Also visible in FIG. 3 is the optional use of at least one standoff 105. Standoff 105 provides additional upright stability of package 1000. Said standoff may be constructed in a variety of shapes including, but not limited to, round, square, rectangular, "W"-shaped. The width of said standoff(s) may vary. In an exemplary embodiment, the standoff may be about equal to the width of the stabilizer. In another exemplary embodiment, the standoff may be narrower or wider than the width of the stabilizer. Depending on the overall size of the disposable diaper product, it may be desirable to design the standoff(s) to have a minimum width equal to about 20% of the disposable diaper product width in order to achieve sufficient stability. In another exemplary embodiment, the standoff may consist of two or more discontinuous elements, either linearly or non-linearly aligned. The height of the standoff may also vary. Depending on the overall size of the disposable diaper product, it may be desirable to design the standoffs to have a height of about 6 mm to 20 mm for a corrugated carton board, other materials may require different heights.

Figure 4:
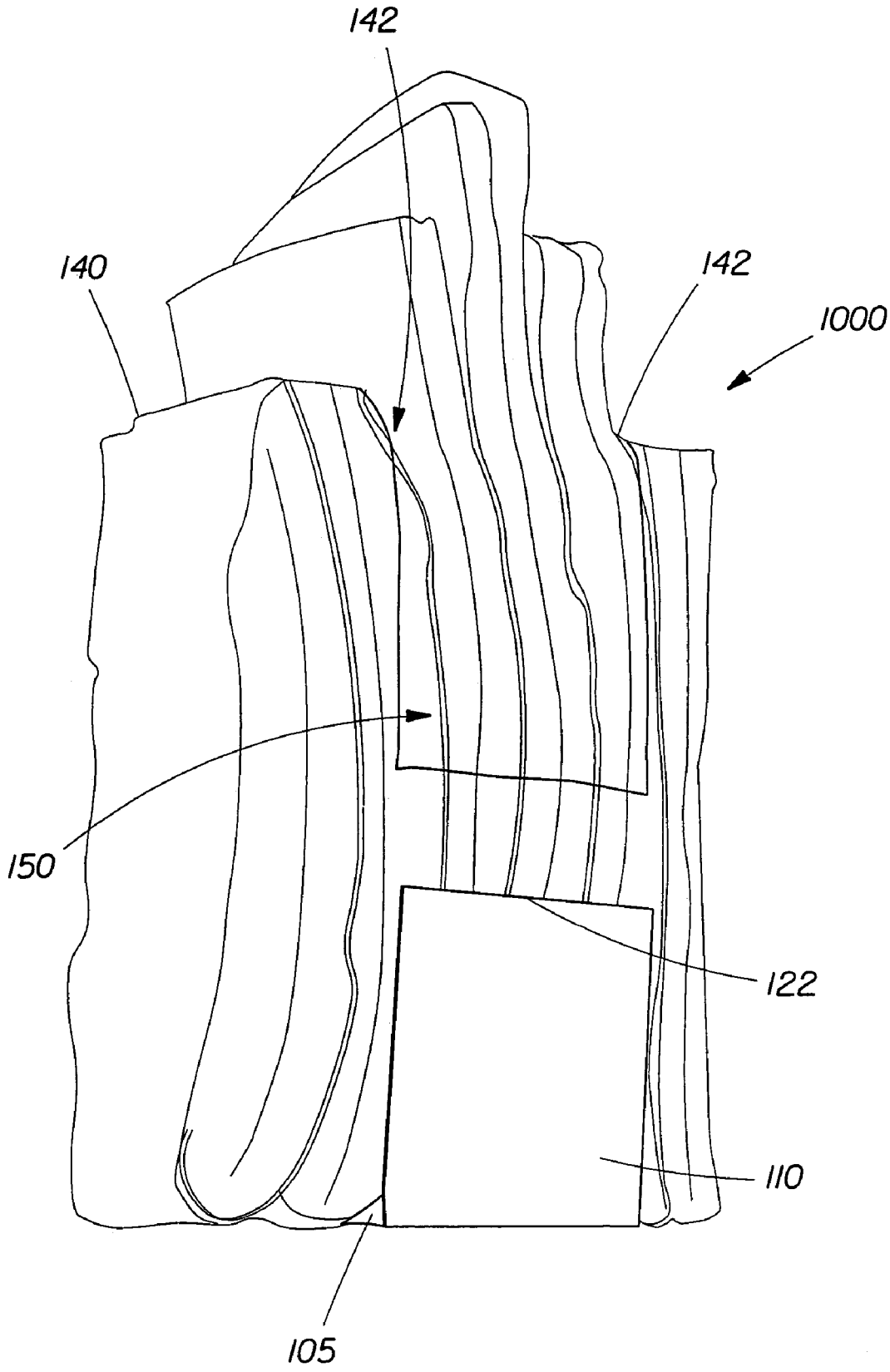
FIG. 4 is a perspective view of the easy-open, re-closable package from FIG. 3 wherein a disposable diaper has begun to be removed from the package though said opening.

FIG. 4 shows opening 150 being enlarged by way of further propagation of perforation 142 for easy removal of an individual disposable diaper from the package.

Figure 5:
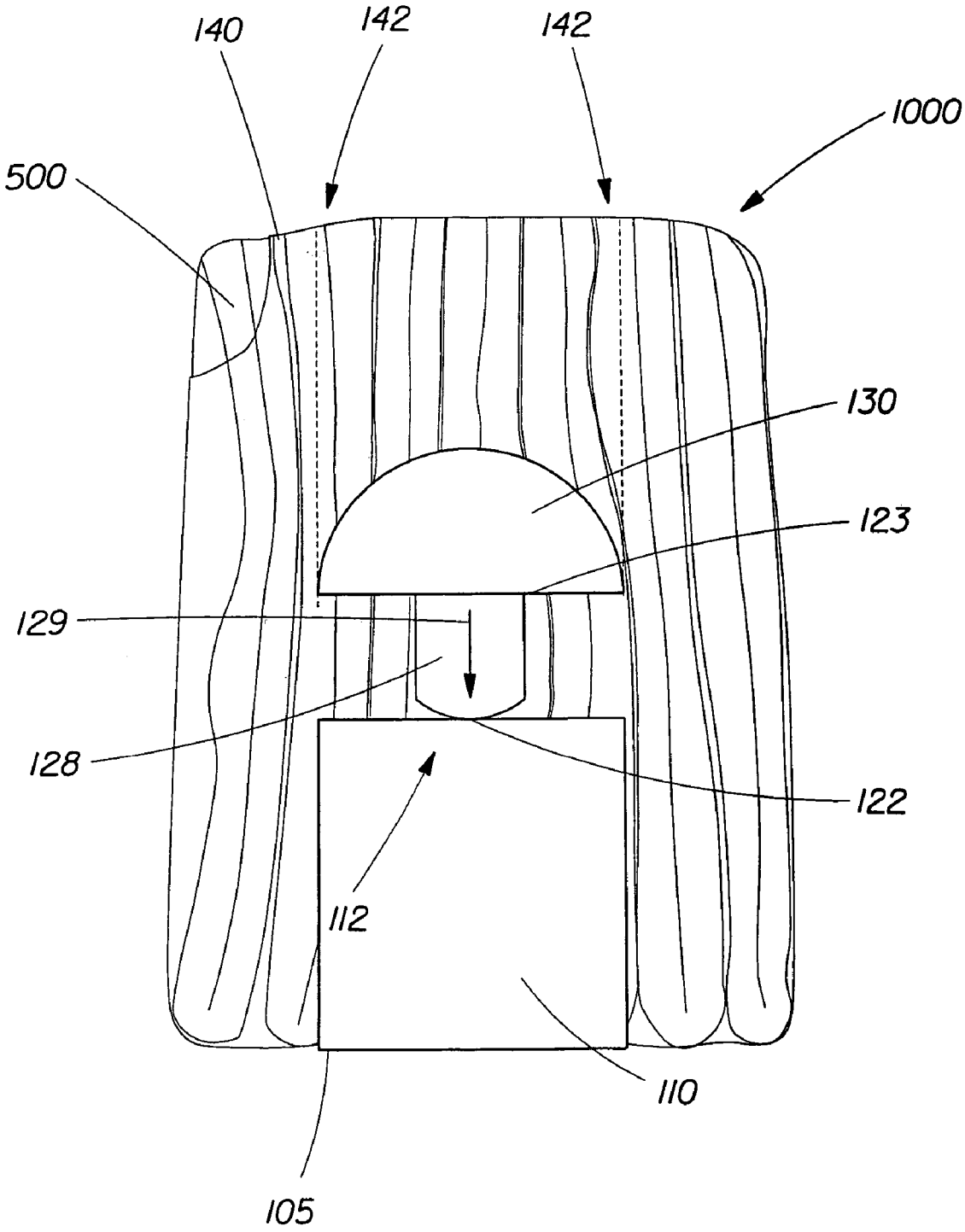
FIG. 5 is a front, elevational view of the re-closable package from FIG. 4 wherein the fastening elements are being aligned for subsequent fastening and closure.

FIG. 5 shows easy-open, re-closable package 1000 beginning to be re-closed. More specifically, male fastening portion 130 is positioned in alignment with and moved towards female fastening portion 110 in a direction as indicated by arrow 129. Female fastening portion 110 may include a female fastening element 112 (not shown). Said female fastening element 112 may include, but is not limited to, a receiving element capable of engagement with male fastening tab 128. In an alternative embodiment, male fastening tab 128 may be positioned between the plurality of disposable diapers 500 and the wrapping layer 140 in order to close said package thus eliminating the need for fastening element 112 all together. One skilled in the art would appreciate that a variety of engagement means may be incorporated including, but not limited to, force fitment of said fastening tab/elements.

All documents cited in the Detailed Description of the Invention are, in relevant part, incorporated herein by reference; the citation of any document is not to be construed as an admission that it is prior art with respect to the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An easy-open, re-closable package for a plurality of disposable diapers, said package comprising:

a plurality of disposable diapers;

a wrapping layer, said wrapping layer substantially surrounding said plurality of disposable diapers, wherein said wrapping layer defines a first pair of tear lines extending substantially along a first direction; and a re-closable fastening system, said re-closable fastening system being joined with said wrapping layer, said re-closable fastening system defining a second pair of tear lines extending substantially along a second direction, and a removable portion disposed between the second pair of tear lines, wherein the second direction intersects said first direction, the re-closable fastening system having a first fastening portion and a second fastening portion, said fastening portions being releasably engageable.

2. The re-closable package of claim 1, wherein said removable portion is integrally formed within said re-closable fastening system, said removable portion having a grip portion, wherein pulling upon said grip portion results in the tearing along of said perforations along the second direction so as to open said package.

3. The re-closable package of claim 2, wherein said first fastening portion is translated along said first tear lines to further open said package.

4. The re-closable package of claim 1, wherein said first direction is substantially perpendicular to said second direction.

5. The re-closable package of claim 1, wherein said first fastening portion is a male fastening element and wherein said second fastening portion is a female fastening element configured to releasably receive the male fastening element.

6. The re-closable package of claim 5, wherein said male fastening portion comprises an elongated tab, and wherein said female fastening portion comprises a slot configured to receive said elongated tab.

7. An easy-open, re-closable package for a plurality of disposable diapers, said package comprising:

a plurality of disposable diapers;

a wrapping layer, said wrapping layer substantially surrounding said plurality of disposable diapers;

a re-closable fastening system, said re-closable fastening system being joined with said wrapping layer, said re-closable fastening system having an elongated tab, said elongated tab being releasably engageable between said plurality of disposable diapers and said wrapping layer; and a removable portion, said removable portion being integrally formed within said re-closable fastening system, said removable portion having a grip portion, said removable portion being defined by a first perforation and a second perforation, wherein pulling upon said grip portion results in the tearing along of said perforations so as to open said package.

* * * * *